US008818250B2

(12) United States Patent
Wazumi et al.

(10) Patent No.: US 8,818,250 B2
(45) Date of Patent: Aug. 26, 2014

(54) FIXING DEVICE AND IMAGE FORMING APPARATUS

(75) Inventors: Toshihiro Wazumi, Hino (JP); Jinju Okuno, Hino (JP)

(73) Assignee: Konica Minolta, Inc., Tokyo (JP)

( * ) Notice: Subject to any disclaimer, the term of this patent is extended or adjusted under 35 U.S.C. 154(b) by 308 days.

(21) Appl. No.: 13/289,355

(22) Filed: Nov. 4, 2011

(65) Prior Publication Data

US 2012/0114400 A1 May 10, 2012

(30) Foreign Application Priority Data

Nov. 9, 2010 (JP) ..... 2010-250589

(51) Int. Cl.
*G03G 15/20* (2006.01)

(52) U.S. Cl.
USPC ..... 399/323

(58) Field of Classification Search
USPC ..... 399/107, 110, 122, 320, 322, 323, 328, 399/329
See application file for complete search history.

(56) References Cited

U.S. PATENT DOCUMENTS

| | | | | |
|---|---|---|---|---|
| 4,065,120 | A * | 12/1977 | Imaizumi et al. | 271/311 |
| 8,331,839 | B2 * | 12/2012 | Kunii et al. | 399/323 |
| 8,433,229 | B2 * | 4/2013 | Murakami et al. | 399/323 |

FOREIGN PATENT DOCUMENTS

| | | |
|---|---|---|
| JP | S63-140571 | 9/1988 |
| JP | 2003-233266 | 8/2003 |
| JP | 2005-202043 A | 7/2005 |
| JP | 2009-205131 | 9/2009 |

OTHER PUBLICATIONS

Notice of Reasons for Refusal in Japanese Patent Application No. 2010-250589, dated Dec. 3, 2013 (3 pages).

* cited by examiner

*Primary Examiner* — Hoan Tran
(74) *Attorney, Agent, or Firm* — Holtz Holtz Goodman & Chick PC

(57) ABSTRACT

A fixing device to fix a toner image on a recording medium in a nip portion formed by a heated fixing member and a pressure member, the fixing device including: an air ejection section to eject and blow air against the recording medium to separate the recording medium from the fixing member, a first guide member provided on a fixing face side of the recording medium discharged from the nip portion to guide the recording medium, a second guide member provided on a non-fixing face side of the recording medium discharged from the nip portion to guide the recording medium, also having a predetermined clearance with respect to the pressure member, and an air suction section provided on a opposite side position with respect to the first guide member in the second guide member to suction air of the clearance and attract the recording medium to the second guide member.

8 Claims, 8 Drawing Sheets

FIXING DEVICE AND IMAGE FORMING APPARATUS

RELATED APPLICATION

The present application is based on Patent Application No. 2010-250589 filed at the Japan Patent Office on Nov. 9, 2010 and which is hereby incorporated herein in its entirety.

TECHNICAL FIELD

The present invention relates to a fixing device to fix a toner image on a recording medium, in a nip portion formed by a fixing member and a pressure member and an image forming apparatus provided with the fixing device.

BACKGROUND

In an electrophotographic image forming apparatus such as a copier, a printer, a facsimile machine, and a multifunction peripheral provided with these functions, a latent, image corresponding to an original document is formed on a photoreceptor; a toner is provided on this latent image to be visualized; the thus-visualized toner image is transferred onto a recording sheet; and then the toner mage having been transferred on the recording sheet is fixed to be discharged.

As a fixing device to fix a toner image in such a manner, available is a heat roller fixing-type fixing device in which while a recording sheet, on which a toner image has been transferred, is nipped/conveyed in a nip portion formed by a fixing roller incorporating a halogen heater and a pressure roller to press the fixing roller, heating/pressing is carried out. Such a fixing device is being widely used due to simplicity and convenience.

Further, available is a belt fixing-type fixing device in which an endless fixing belt is stretched by a heating roller incorporating a halogen heater and a fixing roller and also a pressure roller to press the fixing roller via the fixing belt is provided; and while a recording sheet on which a toner image has been transferred is nipped/conveyed in a nip portion formed by the fixing belt and the pressure roller, heating/pressing is carried out. In such a fixing device, since the heat capacity of the fixing belt is small, advantages such as reduced warming-up time and energy saving are produced.

Incidentally, since the toner of a toner image on a recording sheet is heated during passing through the nip portion, the toner comes to have adhesion force, and thereby the recording sheet having passed through the nip portion adheres to and winds around the surface of the fixing roller or the fixing belt and then does not separate therefrom, resulting in the possibility of jamming. Especially when as a recording sheet, a sheet of small weight (thin paper), specifically, printing coated paper of small weight is used, separation performance is decreased.

On the other hand, in image forming apparatuses, speeding-up is in progress. Thereby, when the fixing roller is enlarged to ensure a nip width having adequate length corresponding to this situation, the roller curvature at the fixing nip exit is decreased, resulting in decreased separation performance.

To easily separate a recording sheet from the fixing member, various kinds of countermeasures have been taken such that for the surface layer of a fixing member, a heat resistant resin of enhanced releasability is used; a releasing agent such as silicone oil is coated; and in a toner, a wax which is melted by heating to function as a releasing agent is incorporated. However, there are increasing factors decreasing separation performance such as image formation on coated paper as described above and an increase in toner adhesion force due to an increase in toner amount to laminate toners of plural colors for color image formation. Therefore, a separation member to separate a recording sheet is necessitated.

As the separation member, there is a method in which on the sheet discharging side of a recording sheet with respect to the nip portion, a separation claw on which a fluorine resin exhibiting enhanced releasability is coated is provided and its tip portion is brought into contact with the outer surface of the fixing roller or the fixing belt to separate the recording sheet from the fixing roller.

However, since the tip portion of the separation claw is in contact with the surface of the fixing roller, there is noted a problem such that scratches occur on the surface layer formed of a fluorine resin to cover the surface of the fixing roller and then such scratches are also transferred onto an image eventually. Especially in the case of a color image, since a glossy image is demanded, such a problem tends to be markedly produced.

To respond to such problems, techniques, in which air is blown against the exit side of the nip portion to separate a recording sheet from the fixing roller, have been developed.

As one example thereof, there is known a fixing device in which compressed air having been produced by a compressor is ejected to the nip portion in a pulsing manner to separate a recording sheet from the fixing roller (refer to Japanese Patent Application Publication No. 2005-202043).

Further, there is known a fixing device in which a separation claw is provided and also air having been blown by a fan is blown against the nip portion to separate a recording sheet from the fixing roller (refer to Japanese Utility Model Application Publication No. S63-140571).

Over recent years, the speeding-up of an image forming apparatus to increase the number of printed sheets per time is advancing. To separate a recording sheet in response to such speeding-up, the amount of ejected air needs to increase. Further, when the recording sheet is thin paper, separation is difficult to carry out compared with plain paper, whereby the amount of ejected air needs to increase further.

On the other hand, since air is blown toward the fixing roller in the vicinity of the nip portion to separate a recording sheet, the air is bounced toward the pressure roller to press the fixing roller and further bounced by the pressure roller, whereby a swirling current of the air is generated on the nip portion exit side. When such a swirling current of the air is generated, the recording sheet having been discharged after fixing is applied with a force so as to be sucked up from the non-fixing face side to the fixing face side.

Herein, the fixing face side of the recording sheet refers to a sheet face in which a toner image has been fixed in an immediately preceded fixing step and the non-fixing face refers to the rear face thereof.

Further, on the fixing face side and the non-fixing face side of a recording sheet, a guide plate to guide the recording sheet is arranged. Thereby, the following state is repeated: when sucked up, a recording sheet is strongly brought into pressure contact wish the guide plate of the fixing face side, bent sharply there, and further brought into pressure contact with the guide plate of the non-fixing face side, resulting in being bent sharply again to be brought into pressure contact with the guide plate of the fixing face side. In other words, there is produced such a phenomenon that a recording sheet undulates up and down, resulting in fluttering.

When the fixing face side of a recording sheet is strongly brought into pressure contact with the guide plate in such a manner, a toner image after fixing may be occasionally flawed, resulting in the possibility of image defects. Further, in some cases, in a coated layer, folding lines are produced, leading to deformation of the recording sheet.

In view of such problems, the present invention was completed. An object of the present invention is to propose a fixing device constituted in such a manner that in cases in which a recording sheet is separated by air blowing, even when the amount of air is increased in response to speeding-up and thin paper, no image defects due to undulation of a recording sheet having been discharged after fixing are generated, and an image forming apparatus provided with the fixing device.

Herein, in Japanese Patent Application Publication No. 2005-202043 and Japanese Utility Model Application Publication No. S63-140571, air is blown for separation but the problem that a swirling current of air is generated is not described, and in addition, no solving method therefor is described.

SUMMARY

1. To achieve at least one of the above mentioned objects, a fixing device to fix a toner image on a recording medium in a nip portion formed by a heated fixing member and a pressure member to press the fixing member, the fixing device reflecting one aspect of the present invention includes, an air ejection section to eject and blow air against the recording medium to separate the recording medium from the fixing member, a first guide member provided on a fixing face side of the recording medium discharged from the nip portion to guide the recording medium, a second guide member provided on a non-fixing face side of the recording medium discharged from the nip portion to guide the recording medium, also having a predetermined clearance with respect to the pressure member, and an air suction section provided on a opposite side position with respect to the first guide member in the second guide member to suction air of the clearance and attract the recording medium to the second guide member.

2. In the abovementioned fixing device of item 1, wherein the air ejection section ejects air blown by a fan.

3. In the abovementioned fixing device, of item 1 or item 2, further comprises a second air ejection section to eject high pressure air produced by a compressor in which at the opposite side position with respect to the first guide member in the air ejection section.

4. In the abovementioned fixing device of items 1-3, wherein the first guide member is a side wall of a duct of the air ejection section.

5. In the abovementioned fixing device of items 1-4, wherein the second guide member is a side wall of a duct of the air ejection section.

6. In the abovementioned fixing device of items 1-5, further comprises a separation claw to separate the recording medium from the pressure member.

7 in the abovementioned fixing device of item 6, wherein a plurality of the separation claws is arranged at the clearance with a predetermined interval, and the air suction section executes the suction of air through the clearance.

8. An image forming apparatus provided with a fixing device described in any one of items 1-7.

DESCRIPTION OF THE PREFERRED EMBODIMENT

Figure 1:
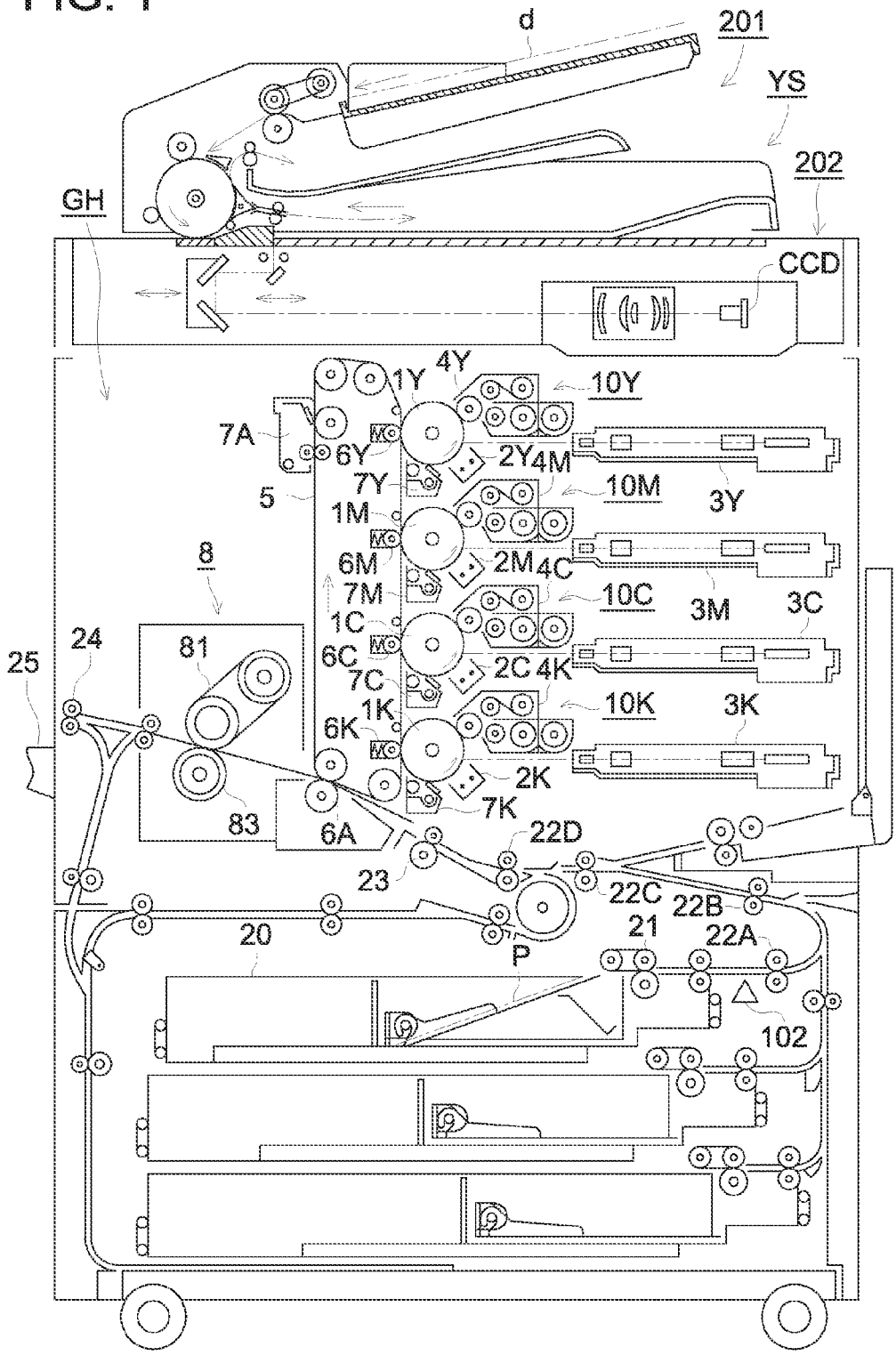
FIG. 1 is a constitutional view of an image forming apparatus.

A preferred embodiment of the present invention will now be described with reference to the drawings.

Initially, one example of an image forming apparatus employing the present invention will now be described based on the constitutional view of FIG. 1.

The present image forming apparatus incorporates an image forming apparatus main body GH and an image reading apparatus YS.

The image forming apparatus main body GH is referred to as a tandem-type color image forming apparatus, incorporating a plurality set of image forming sections 10Y, 10M, 10C, and 10K, a belt-shaped intermediate transfer belt 5, a sheet feed/conveyance member, and a fixing device 8.

On top of the image forming apparatus main body GH, the image reading apparatus YS incorporating an automatic document feeder 201 and a document image scanning/exposing device 202 is placed. An original document d having been placed on the document platen of the automatic document feeder 201 is conveyed by a conveyance member and then an image of one side or images of both sides of the original document are seasoned and exposed by the optical system of the document image scanning/exposing device 202 to be read in a line image sensor CCD.

A signal having been formed via photoelectrical conversion using the line image sensor CCD is subjected to analog processing, A/D conversion, shading correction, and image compression processing in an image processing section to be sent to exposure members 3Y, 3M, 3C, and 3K.

The image forming section 10Y, forming a yellow (Y) color image, has, in the periphery of a photoreceptor drain 1Y, a charging member 2Y, an exposure member 3Y, a developing member 4Y, and a cleaning member 7Y. The image forming section 10M, forming a magenta (M) color image, has, in the periphery of a photoreceptor drum 1M, a charging member 2M, an exposure member 3M, a developing member 4M, and a cleaning member 7M. The image forming section 10C, forming a cyan (C) color image, has, in the periphery of a photoreceptor drum 1C, a charging member 2C, an exposure member 3C, a developing member 4C, and a cleaning member 7C. The image forming section 10K, forming a black (K) color image, has, in the periphery of a photoreceptor drum 1K, a charging member 2K, an exposure member 3K, a developing member 4K, and a cleaning member 7K. The charging member 2Y and the exposure member 3Y, the charging member 2M and the exposure member 3M, the charging member 2C and the exposure member 3C, and the charging member 2K and the exposure member 3K each constitute a latent image forming member.

Herein, the developing members 4Y, 4M, 4C, and 4K incorporate a two component developer containing a toner of small-particle diameter of yellow (Y), magenta (M), cyan (C), and black (K), and a carrier, respectively. Such a toner contains a pigment or a dye serving as a color former, a wax to help the toner to separate from the fixing member after fixing, and a binder resin to hold them.

The intermediate transfer belt 5 is wound around a plurality of rollers, being rotatably supported.

The fixing device 8 heats/presses a toner image on a recording sheet (recording medium) P in a nip portion formed between the heated fixing belt 81 and the pressure roller 83 for fixing.

In such a manner, an image of each of the colors having been formed by the image forming sections 10Y, 10M, 10C, and 10K is sequentially transferred onto the rotating intermediate transfer belt 5 by the transfer members 6Y, 6M, 6C, and 6K (primary transfer) to form a toner image in which color image composition has been carried out. A recording sheet P stored in a sheet feeding cassette 20 is fed by a sheet feeding member 21, passed through sheet feeding rollers 22A, 22B, 22C, and 22D, and a registration roller 23, and then conveyed to the transfer member 6A to transfer the color image onto the recording sheet P (secondary transfer). The recording sheet P on which the color image has been transferred is heated/pressed in the fixing device 8 to fix the color toner image on the recording sheet P, being, thereafter, nipped by the sheet discharging roller 24 to be stacked on the sheet discharging tray 25 outside the machine.

On the other hand, after the color image has been transferred onto the recording sheet P by the transfer member 6A, in the intermediate transfer belt 5 having curvature-separated the recording sheet P, the residual toner is eliminated by the cleaning member 7A.

Incidentally, the above description has been made with respect to an image forming apparatus to form a color image, being, however, applicable also to an image forming apparatus to form a monochrome image. Further, the intermediate belt may be used or not.

Next the fixing device 8 according to the present invention will be described based on the sectional view of the belt fixing device of FIG. 2.

The fixing belt 81 (a fixing member) is formed in an endless manner. For example, as a base body, PI (polyimide) of a thickness of 70 μm is used. The outer circumferential face of the base body is covered with a heat resistant silicone rubber (hardness: JIS-A 30°) of a thickness of 200 μm as an elastic layer and further coated with PFA (perfluoroalkoxy) which is a heat resistant resin of a thickness of 30 μm. The circumference length is, for example, 528 mm. For other configurations, as the base body, a metal base body such as a nickel electrocast may be used; as the elastic layer, fluorine rubber may be used; and the surface releasing layer may be covered with PFA or PTFE (polytetrafluoroethylene).

The heating roller 82 incorporates a halogen heater 82A serving as a heating member to heat the fixing belt 81. For example, the outer circumferential face of a cylindrical core metal 82B of a wall thickness of 4 mm formed of aluminum is covered with a resin layer 82C coated with PTFE of a thickness of 30 μm. The outer diameter size is, for example, 90 mm. Herein, the halogen heater 82A incorporates, for example, 2 halogen heaters of 1200 W, 2 halogen heaters of 750 W, and a halogen heater of 500 W to respond to different sheet width, being arranged so as to have heat producing distribution differing in the shaft direction in response to the different sheet widths of recording sheets.

With regard to the fixing roller 83, a solid core metal 83A formed of metal such as ion is covered with a heat resistant silicone rubber (hardness: JIS-A 5°) of a thickness of 20 mm serving as the elastic layer 83B and further covered with a resin layer 83C coated with PTFE which is a low frictional heat resistant resin of a thickness of 30 μm. The outer diameter size is, for example, 90 mm.

The pressure roller 84 (a pressure member) incorporates a halogen heater 84A to reduce temperature raising duration immediately after power activation for the image output apparatus. The outer circumferential face of a cylindrical core metal 84B of a wall thickness of 4 mm formed of aluminum is covered with a heat resistant silicone rubber (hardness: JIS-A 30°) of a thickness of 1 mm serving as an elastic layer 84C and further covered with a resin layer 84D of a PFA tube of a thickness of 30 μm. The outer diameter size is, for example, 80 mm. Herein, the halogen heater 84A has, for example, an electrical power of 700 W.

The fixing belt 81 is stretched by the heating roller 82 and the fixing roller 83. The pressure roller 84 presses the fixing roller 83 via the fixing belt 81 by an energizing member which is not shown.

In the above constitution, when the pressure roller 84 is rotated in the counterclockwise direction by an unshown drive member, the fixing belt 81 and the heating roller 82 are rotated in the clockwise direction and also the fixing roller 83 is rotated in the clockwise direction. Herein, the fixing roller 83 may be driven. Further, the fixing belt 81 is heated, via the heating roller 82 in contact therewith, by the halogen heater 82A, and the pressure roller 84 is also heated by the halogen heater 84A. And, since the pressure roller 84 has been being energized toward the fixing roller 83, a recording medium P having been fed is heated/pressed in the nip portion N formed between the fixing belt 81 wound around the fixing roller 83 and the pressure roller 84 to fix a toner image on the recording medium P.

Herein, fixing conditions are as follows.

Fixing load: 2500 N

Fixing belt tension: 250 N

Fixing belt control temperature: 160-200° C.

Pressure roller control temperature: 80-120° C.

Recording sheet conveyance rate: 500 mm/s

Further, as the heating member to heat the fixing belt 81, any appropriate heating member is employable. For example, an induction heating heat-producing body employing an exciting coil may be used. Still further, the position where the heating member is placed is not necessarily limited within the heating roller 82.

Furthermore, a tension roller to provide tension for the fixing belt 81 may be provided, and a one-sided moving control roller to control belt meandering may be provided.

As described above, in the fixing device 8, when a recording medium P having been subjected to fixing is discharged from the nip portion P and thereafter allowed to adhere to the fixing belt 81, followed by being wound therearound, jamming may occur. Therefore, the recording medium P needs to be certainly separated from the fixing belt 81.

Therefor, in the present fixing device 8, as this separation member, a first air nozzle 111 (a second air ejection section) and a second air nozzle 121 (an air ejection section) are provided in the vicinity of the exit side of the nip portion N. The first air nozzle 111 ejects compressed air having been produced via compressor compression and then carries out short duration blowing against the vicinity of the tip portion of the recording sheet P immediately after passing through the nip portion N. On the other hand, the second air nozzle 121 continuously ejects air having been blown by the air blowing fan 123 via the duct 122 to blow the air against the recording sheet P whose tip portion has been separated so as not to adhere to the fixing belt 81.

Incidentally, the tip portion of the first air nozzle 111 is located 25 mm from the exit side of the nip portion N, blowing air against the outer circumferential face of the fixing belt 81 located 10 mm from the exit portion of the nip portion N. The second air nozzle 121 is also located 25 mm from the exit side of the nip portion N, blowing air against the outer circumferential face of the fixing belt 81 located 10 mm from the exit portion of the nip portion N. And, in the vicinity of the exit portion of the nip portion N, an air flow of about 40 m/s is formed ranging from the fixing face side of the fixing roller 83 side of the recording sheet P to the non-fixing face side of the pressure roller 84 side.

Air ejected from the first air nozzle 111 needs to have large air velocity to separate the tip portion of the recording sheet P from the fixing belt 81. However, since ejection is carried out in a short period of time, the air volume may be small. On the other hand, since air is ejected from the second air nozzle 121 after separation of the tip portion of the recording sheet P, its air velocity may be smaller than in the first air nozzle 111. However, since continuous ejection is carried out until the entire recording sheet P is passed through the nip portion N, its air volume needs to be larger than in the first air nozzle 111. Herein, the air volume from the first air nozzle 111 needs only to be about 1/10 of that from the second air nozzle 121. In this manner, a constitution such that the first air nozzle 111 and the second air nozzle 121 are complementary to each other is employed. Thereby, compared with a constitution in which only compressed air is ejected from the first air nozzle 111 with no second air nozzle 121, the size of the air tank can be reduced, resulting in electrical power saving.

In this manner, the recording sheet P having been separated from the fixing belt 81 is guided by the outer wall 122A (a first guide member) of the duct 122 and the sheet discharging guide plate 85 (a second guide member) to be conveyed. Herein, a separation claw 86 formed of a heat resistant resin is in contact with the pressure roller 84. Therefore, even when tire recording sheet P is pressed downward by air from the first air nozzle 111 or the second air nozzle 121, the recording sheet P will not be wound around the pressure roller 84. Further, the separation claw 86 has, for example, a tip width of 12 mm and a tip R of at most 0.05 mm. The claw tip is located 12 mm from the exit portion of the nip portion N and 7 claws are arranged in the shaft direction of the pressure roller 84. The base material is PI coated with PFA, resulting in excellent lubricity, and pressure contact is made with the pressure roller 84 at a small force of about 1 mN. Therefore, the pressure roller 84 is not flawed. Additionally, in double-sided copying, even when a toner image is located on the pressure roller 84 side, the toner image is not melted due to low temperature of the pressure roller 84 and then no image defects resulting from the separation claw 86 are generated.

Further, as the separation claw 86, those having been used in the conventional fixing devices are employable.

In this manner, the recording sheet P having been fixed and separated is passed between the side wall 122A of the duct 122 and the sheet discharging guide plate 85 to be discharged by being pinched by the sheet discharging roller 88.

Incidentally, although detailed description will be made later, the first air nozzle 111 blows air so as for the tip portion of a recording sheet P not to adhere to the surface of the fixing belt 81 stretched by the fixing roller 83, and after the tip portion of the recording sheet P has been separated, air ejection by the first air nozzle 111 is stopped. Then, air ejection by the second air nozzle 121 allows the recording sheet P not to adhere to the surface of the fixing belt 81 stretched by the fixing roller 83.

At this moment, air having been ejected by the second air nozzle 121 is bounced off the surface of the fixing belt 81 stretched by the fixing roller 83 and further bounced back from the pressure roller 84, whereby on the exit side of the nip portion N, a swirling current of the air is generated. When a swirling current of the air is generated, the recording sheet P is subjected, to a suction force from the non-fixing face side to the fixing face side and then the recording sheet P is strongly brought into pressure contact with the side wall 122A of the duct 22. And there, the recording sheet P is bent sharply and further brought into pressure contact with the sheet discharging guide plate 85 of the non-fixing face side, resulting in being bent sharply again to be brought into pressure contact with the side wall 122A, the state of which is then repeated. In other words, since a state is created in which a recording sheet P undulates up and down, resulting in fluttering, an image after fixing is flawed and thereby image defects may be generated.

Herein, since air is intermittently ejected from the first air nozzle 111 and its air volume is relatively small, there is little influence on occurrence of a swirling current.

To solve such a problem, below the sheet discharging guide plate 85, a suction fan 130 (an air suction section) is provided. The suction fan 130 is arranged inside the suction duct 132 located below the sheet discharging guide plate 85.

Figure 3:
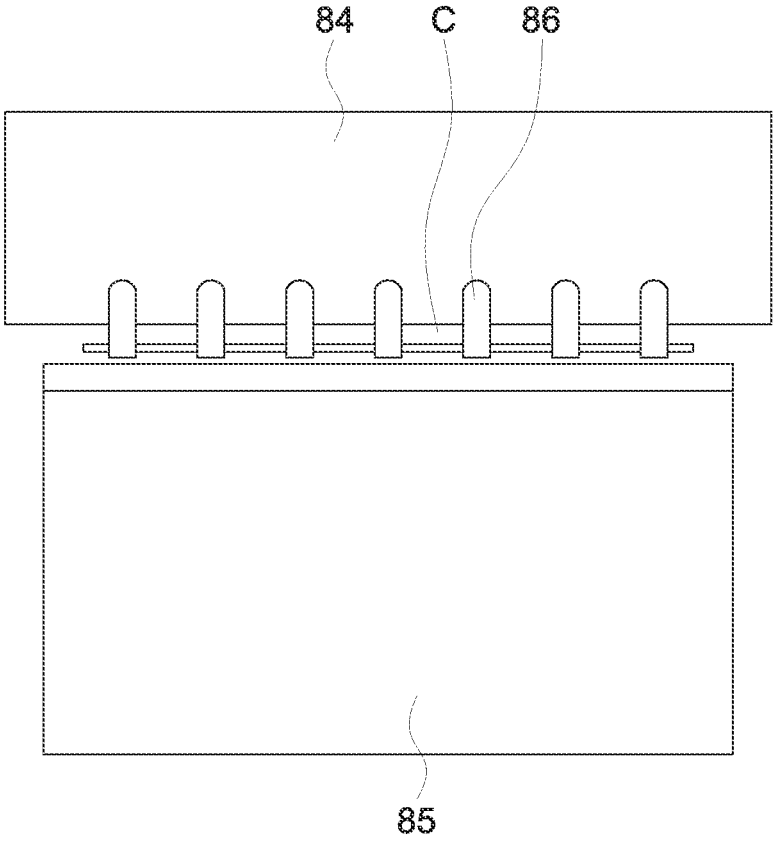
FIG. 3 is a top view of a separation claw, a pressure roller, and a sheet discharging guide plate.

FIG. 3 is a top view of the separation claw 86, the pressure roller 84, and the sheet discharging guide plate 85. The suction duct 132 is arranged on the paper plane back side of the sheet discharging guide plate 85 when referring to FIG. 3. The sheet discharging guide plate 85 and fee suction duct 132 are arranged with a clearance C with respect to the pressure roller 84. The suction fan 130 suctions air from this clearance C. Thereby, a recording sheet P located at the clearance C is suctioned and then attracted by the sheet discharging guide plate 85. Thereby, even when a swirling current is generated by air having been ejected by the second air nozzle 121, the recording sheet P will not undulate up and down. Therefore, the recording sheet P is certainly guided along the sheet discharging guide plate 85 to be discharged by being pinched by the sheet discharging roller 88.

Herein, the suction fan 130 is constituted, for example, of 6 axial flow fans of 40 mm square and its static pressure is 550 Pa.

Further, the sheet discharging roller 88 is formed of, for example, SUS303, and the surface thereof is coated with beads.

Figure 4:
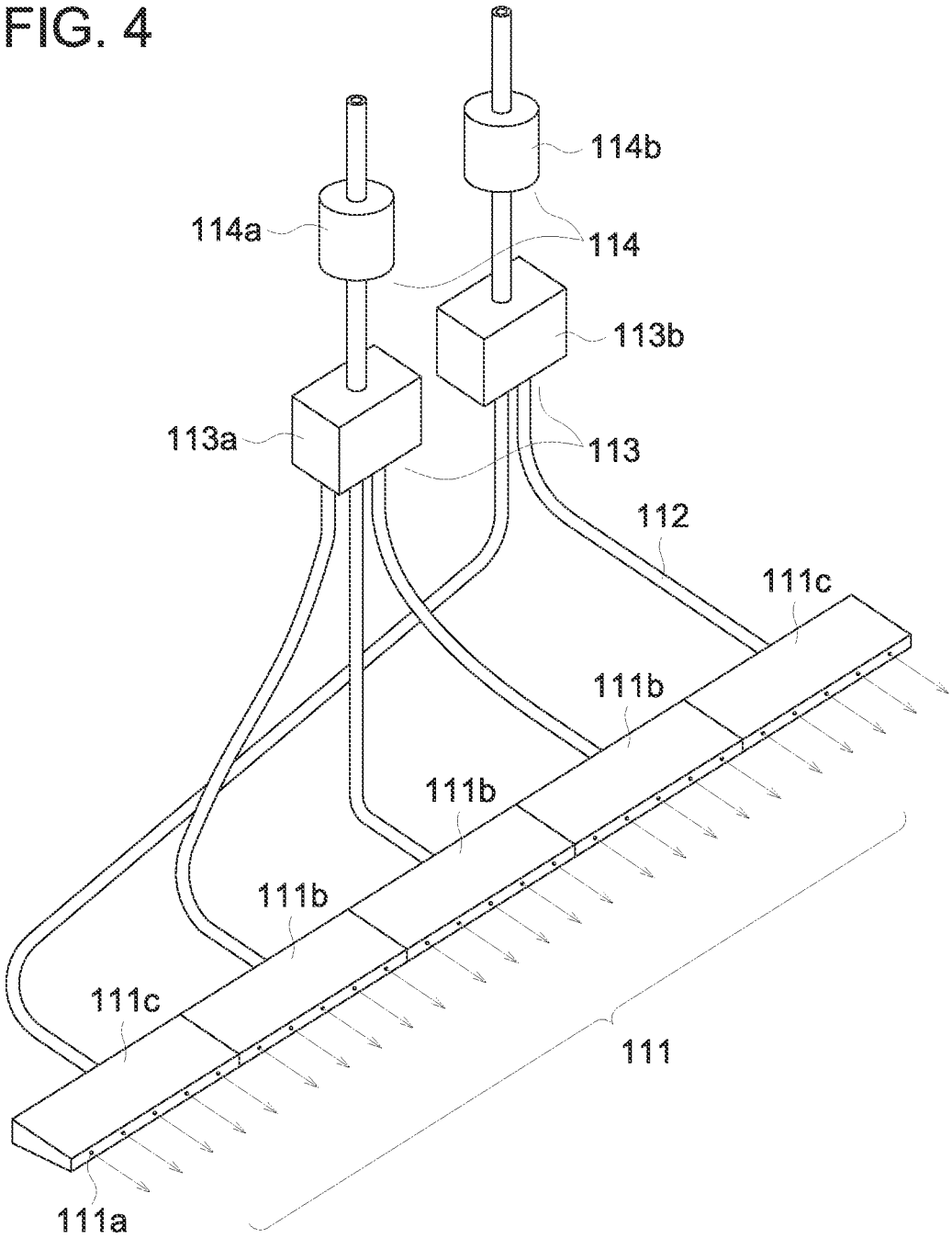
FIG. 4 is a perspective view of a first air nozzle and an electromagnetic valve.
Figure 5:
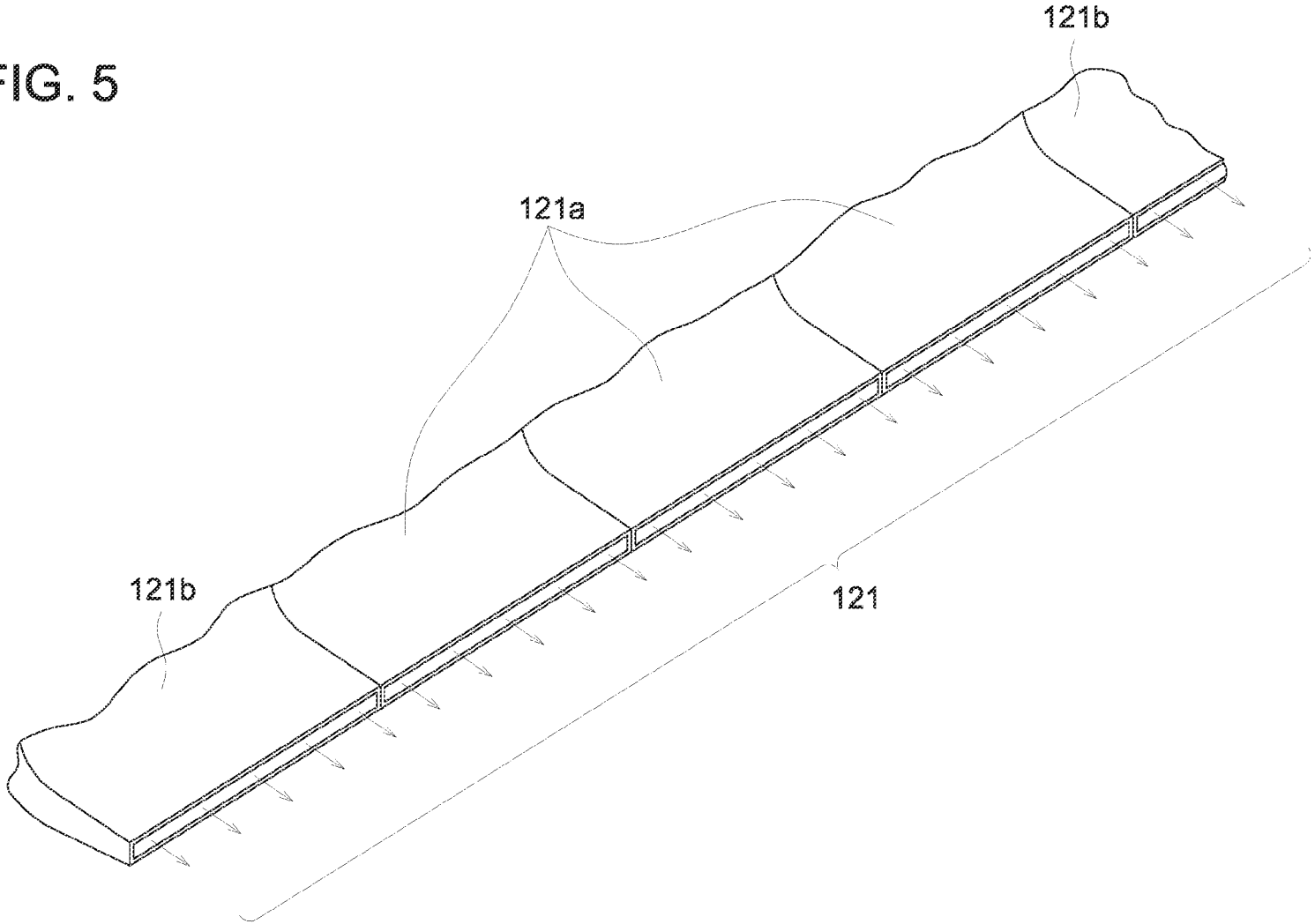
FIG. 5 is a perspective view of a second air nozzle.
Figure 6:
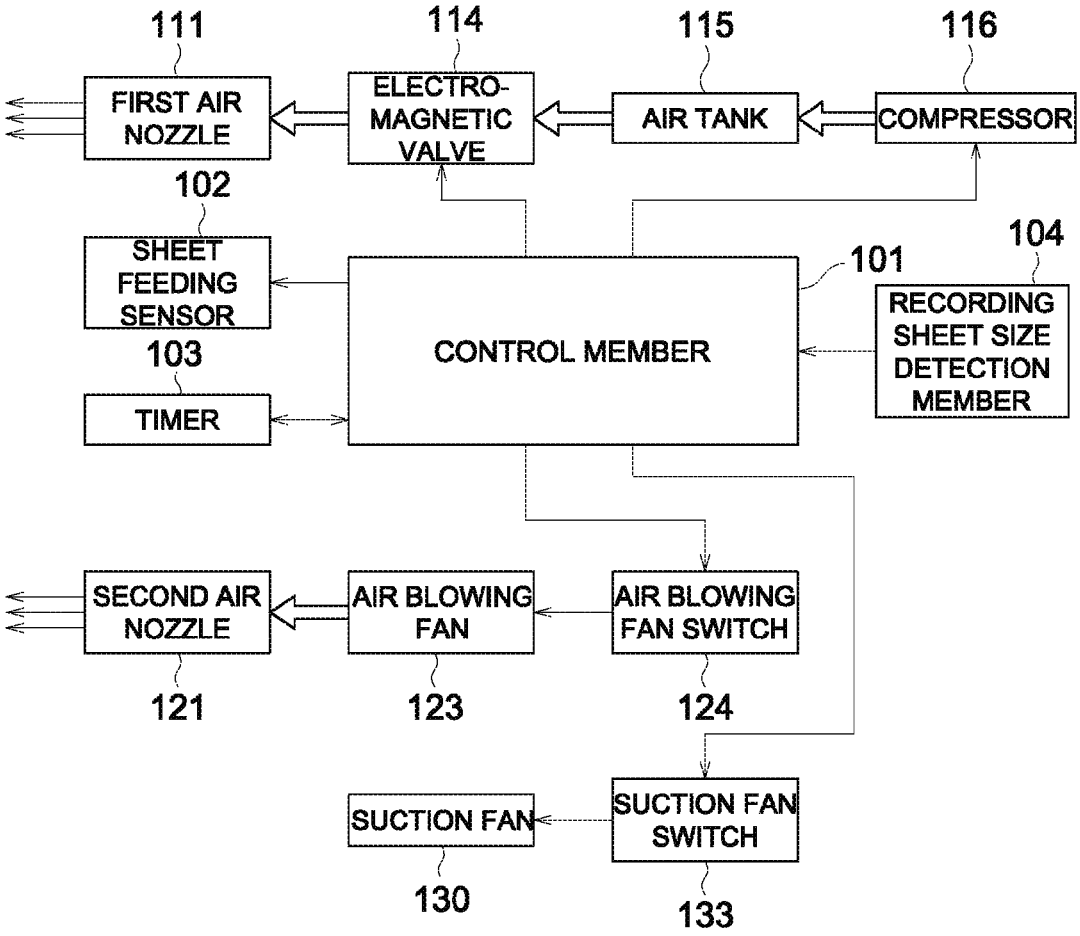
FIG. 6 is a block diagram to control a compressor and fans.

Next, the constitution to eject air from the first air nozzle 111 and fee second air nozzle 121 will be described based on FIG. 4-FIG. 6. FIG. 4 is a perspective view of the first air nozzle 111 and an electromagnetic valve, and FIG. 5 is a perspective view of the second air nozzle 121. FIG. 6 is a block diagram to control a compressor and fans.

Initially, the first air nozzle 111 and its relevant constitution are described based on FIG. 4-FIG. 6.

In FIG. 4, in the width direction of a recording sheet P, 5 first air nozzles 111 are arranged. In each first air nozzle 111, 13 nozzle holes 111*a* of an orifice diameter of 1 mm are provided at a pitch of 5 mm. Therefore, the total number of the nozzle holes 111*a* is 65 in the 5 first air nozzles 111.

Each of the 5 first air nozzle 111 is connected to either of 2 piping sections 113 via one pipe 112. Each of the 2 piping sections 113 is communicatively connected to either of 2 electromagnetic valves 114. No shape of the far side of the electromagnetic valves 114 is shown. However, this side is connected to the air tank 115 shown in FIG. 6 to be integrated, and the air tank 115 is connected to the compressor 116.

Herein, the electromagnetic valve 114 is a direct acting type and has a capacity of 0.001 $m^3/s$ (100 kPa) and a response rate of 20 ms.

The capacity of the air tank 115 is 0.05 $m^3$.

The compressor 116 is a reciprocating, oil-free type and has an electrical power of 0.75 kW, a static pressure of 0.8 MPa, and an air volume of 0.00125 $m^3/s$.

In the image forming apparatus having such a constitution as shown in FIG. 1, the sheet feeding sensor 102 detects that a recording sheet P stored in the sheet feeding cassette 20 has been fed by the sheet feeding member 21. The duration until the recording sheet P having been conveyed passes through the nip portion N from the detection of the sheet feeding sensor 102 is constant and known in advance. When the control member 101 containing a CPU recognizes that tire duration has been reached using a timer 103, an opening signal is transmitted to the electromagnetic vale 114 and after 50 ms, a closing signal is transmitted. Since in the air tank 115, compressed air having been compressed by the compressor 116 is previously retained, with opening of the electromagnetic valve 114, the compressed air is ejected from the first air nozzle 111 and blown against the tip portion of the recording sheet P immediately after passing through the nip portion N.

At this moment, compressed air of about 0.8 MPa having been retained in the air tank by the compressor is decompressed by a regulator, not shown, provided between the air tank, and the first air nozzle to be supplied to the first air nozzle 111. The ejection pressure from the first air nozzle 111 is 0.1-0.2 MPa. The ejection velocity and the ejection air volume are 100-160 m/s and 0.005-0.008 $m^3/s$, respectively, Further, since the electromagnetic valve 114 becomes fully opened about 20 ms after the input of an opening signal, at the moment a recording sheet P has been conveyed about 10 mm from the nip portion, maximum air volume is achieved. The ejection maximum air volume of compressed air from the first air nozzle 111 is 2-3 times as much as the necessary volume to separate the recording sheet P. Therefore, the recording sheet P starts separating before fixe ejection air volume of the compressed air reaches the maximum, namely, before the conveyance distance from the nip portion N reaches 10 mm. Thereafter, when a closing signal is input to the electromagnetic valve 114, the ejection air volume of the compressed air ejected from the first air nozzle 111 is gradually decreased and then ejection is continued until the tip portion of the recording sheet P reaches a distance of 25-30 mm from the nip portion N. The ejection air volume at this moment is an air volume to the extent that a recording sheet P having a toner image even with a maximum adhering amount can be separated.

Incidentally, in FIG. 4, 3 first air nozzles 111*b* arranged on the inner side are connected to the electromagnetic valve 114*a* via the piping section 113*a*, and 2 first air nozzles 111*c* arranged on the outer side are connected to the electromagnetic valve 114*b* via the piping section 113*b*. Further, the width of the 3 first air nozzles 111*b* corresponds to, for example, the size of the short-edge direction of A4 size. In response to an input to the operation panel arranged on top of the image reading apparatus, the recording sheet size detection member 104 detects the size of a recording sheet on which an image will be formed for transmittance to the control member 101.

In this manner, when a recording sheet of A4 size is laterally conveyed, the control member 101 transmits an opening signal to both the electromagnetic valve 114*a* and the electromagnetic valve 114*b*. However, when such a recording sheet of A4 size is longitudinally conveyed, the control member 101 transmits an opening signal only to the electromagnetic valve 114*a*. In this case, no opening signal is transmitted to the electromagnetic valve 114*b*. Thereby, compressed air is prevented from being ejected uselessly and thereby the power consumption of the compressor 116 can be reduced.

Further, in this case, in the halogen heater incorporated in the heating roller, energization is made for those corresponding to the sheet passing area, resulting in power consumption reduction.

As described above, compressed air is ejected from the first air nozzle 111 and then the tip portion of a recording sheet P having passed through the nip portion N is separated from the fixing belt 81; and thereafter, ejection of the compressed air is stopped and instead, air having been blown from the second air nozzle 121 by a fan is continuously ejected and blown against the recording sheet P to prevent the recording sheet P from adhering to the fixing belt 81.

Namely, when a recording sheet P has been separated to some extent and the tip portion of the recording sheet P has been open by at least 0.2 mm from the fixing belt 81, to allow the separation force to act for the entire open area, air to be blown against a wide range with large air volume even at low pressure is more desirable than air to be blown against a narrow range at high pressure such as compressed air ejected from the first air nozzle 111. Therefor, ejection from the first air nozzle 111 is stopped and then air blown from the second air nozzle 121 by the fan is blown against the tip portion having been open from the fixing belt 81 in the recording sheet P. Thereby, even with no blowing from, the first air nozzle 111, a force is applied to the recording sheet P against the adhesion force of a toner and then the recording sheet P is certainly separated from the fixing roller 81.

The second air nozzle 121 and its relevant constitution will now be described based on FIG. 5 and FIG. 6.

In FIG. 5, in the width direction of a recording sheet P, 5 second air nozzles 121 are arranged. The opening of each second air nozzle 121 is formed to allow the size thereof to be 60 mm in the width direction of the recording sheet P and 1.6 mm in the thickness direction of the recording sheet P.

Figure 2:
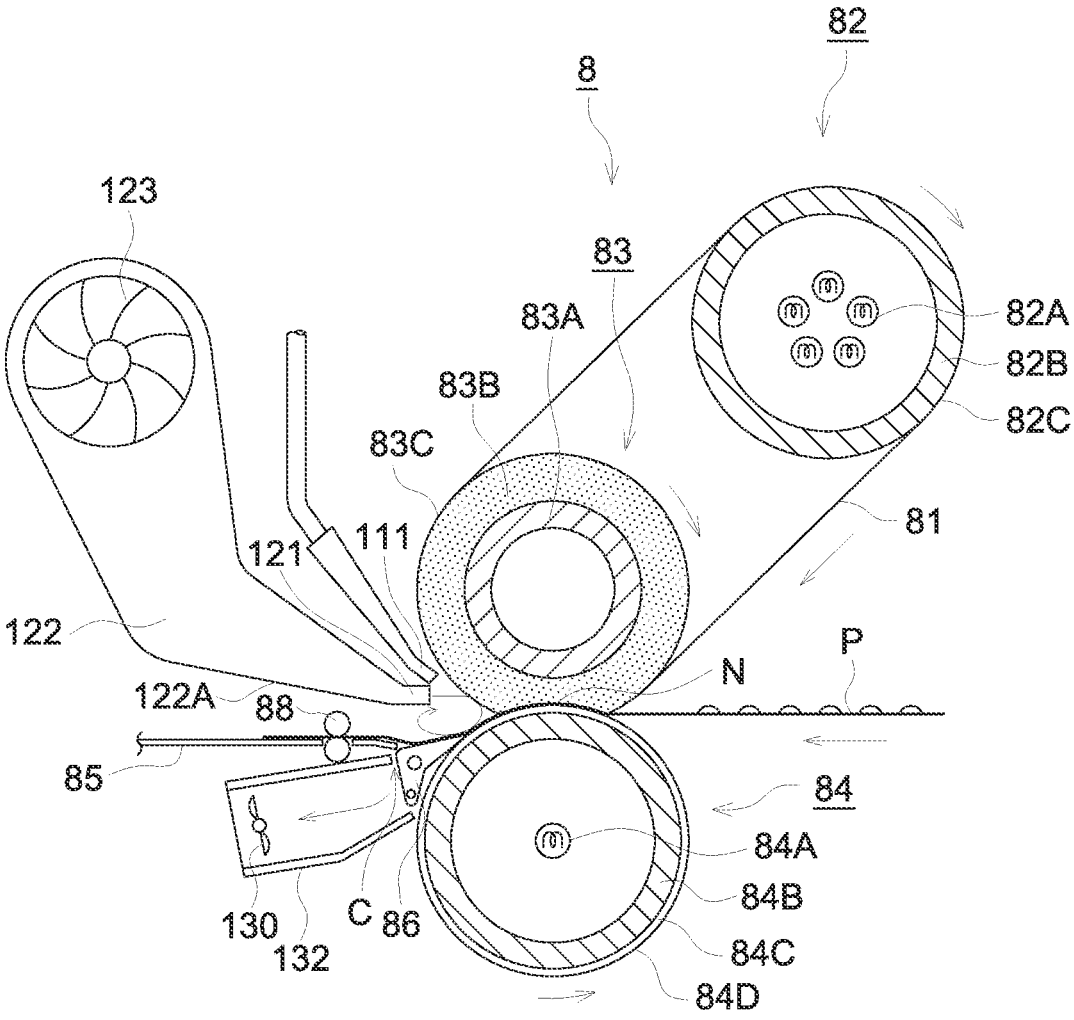
FIG. 2 is a sectional view of a belt fixing device.

And, the 5 second air nozzles 121 are communicatively connected to 5 air blowing fans 123 via the duct 122 as shown in FIG. 2.

The air blowing fan is a sirocco fan of a size of 97 mm×33 mm. Its rated voltage and maximum static pressure are 24 V and 1280 Pa, respectively.

In the image forming apparatus having such a constitution as shown in FIG. 1, when the sheet feeding sensor 102 detects that a recording sheet P stored in the sheet feeding cassette 20 has been fed by the sheet feeding member 21, the control member 101 energizes the air blowing fan switch 124. Therefore, each air blowing fan 123 starts rotating. Then, air is ejected from the second air nozzle 121, for example, at 20 m/s and blown against a recording sheet P to separate the recording sheet P from the fixing belt 81. When recording sheets P are continuously fixed, the air blowing fan 123 is kept operating. However, when the responsiveness of the air blowing fan 123 is sufficiently high, ON/OFF may be repeated in response to entering of recording sheets P.

In such a manner, thin printing coated sheets of a thickness of about 80 $g/m^2$ with a solid image of maximum adhesion amount can be continuously separated.

Further, when the suction fan switch 133 is switched on and then a recording sheet P is suctioned by the suction fan 130, the receding sheet P is not undulated up and down even if a swirling current due to air having been ejected by the second air nozzle 121 has been generated.

Incidentally, the reason why before a recording sheet P readies the fixing device 8, the air blowing fan switch 124 is energized is that there is a time lag until the maximum number of rotations is achieved after the air blowing fan 123 has been energized. In cases in which the recording sheet conveyance rate is small and then sufficient air velocity can be achieved to carry out continuous separation, as described below, by the air blowing fan 123 before the position to separate a recording sheet P is reached, starting-up may be carried out after the recording sheet P has reached the fixing device. In contrast, in the ease of the application of the present invention to a higher-speed image forming apparatus, when a blower of high output power with long rise time is used as the air blowing fan 123, prior to the sheet feeding initiation of the image forming apparatus and the initiation of an image forming operation, the blower is started to appropriately select the start-up timing of the air blowing fan 123.

Further, the ejection pressure from the second air nozzle 121 is 400 Pa. And, the ejection air rate and the ejection air volume are 20-30 m/s and $160\times10^{-5}$ $m^3/s$, respectively.

Still further, the air blowing fan 123 is not limited to a sirocco fan, including an axial flow fan, a cross flow fan, and a blower. Basically, conditions having air volume enabling to continuously peel recording sheets P whose tip portion has been separated from the fixing belt 81 need only to be provided. Then, the shape of the duct 122 is set depending on fee type of the air blowing fan 123.

Incidentally, in FIG. 5, 5 second air nozzles 121 are arranged in the width direction of a recording sheet P. In the same manner as in the first air nozzle 111, the width of the 3 second air nozzles 111*a* arranged inside corresponds to, for example, the size off the short-edge direction of A4 size. The width of the 3 second air nozzles 121*a* and 2 second air nozzles 121*b* arranged outside corresponds to, for example, the size of the long-edge direction of A4 size. The 3 second air nozzles 121*a* are each communicatively connected to 3 air blowing fans 123, and the 2 second air nozzles 121*b* are each communicatively connected to 2 air blowing fans 123. When a recording sheet of A4 size is laterally conveyed, the control member 101 energizes both the air blowing fan switch 124 corresponding to the second air nozzles 121*a* and the air blowing fan switch 124 corresponding to the second air nozzles 121*b* arranged outside. However, what such a recording sheet of A4 size is longitudinally conveyed, the control member 101 energizes only the air blowing fan switch 124 corresponding to the second air nozzles 121*a*. Thereby, useless rotation of the air blowing fan 123 and cooing of the fixing member by air for separation are inhibited, whereby the power consumption of the air blowing fan 123 and the halogen heater 82A can be reduced.

Next, an experiment in order for a recording sheet P not to undulate up and down via suction by the suction fan 130 even if a swirling current due to air having been ejected by the nozzle 121 has been generated will be described.

In the present experiment, the image forming apparatus, as shown in FIG. 1, provided with a fixing device 8 having the first air nozzle 111 and the second air nozzle 121 described above was used, and a recording sheet P of A4 size was fed at 100 ppm.

In the present experiment, a thin paper coated sheet of 60 g/m2 classified into a thin sheet among commonly used remitting sheets was fed. The separation air velocity from the second air nozzle 121 and the suction air velocity from the suction fan 130 were varied to determine optimum conditions.

Figure 7:
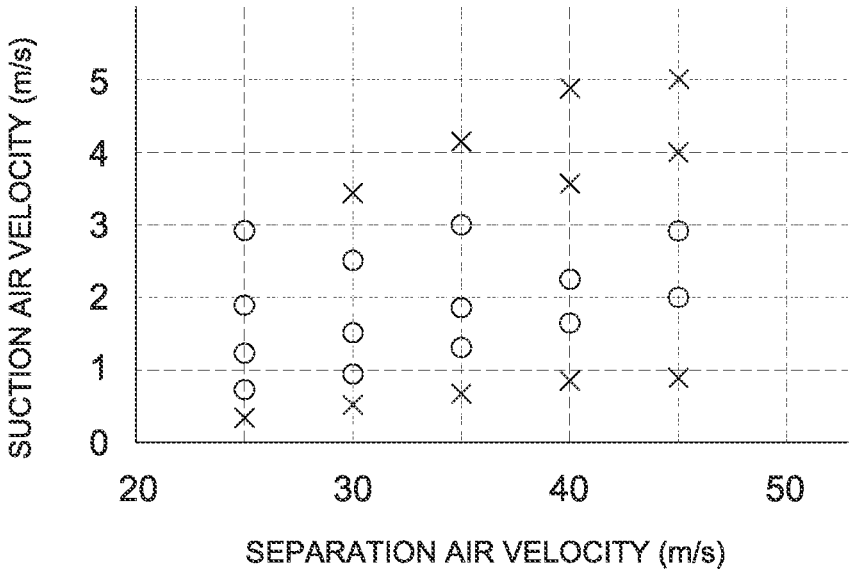
FIG. 7 is a figure of experimental results in which separation air velocity and suction air velocity were changed.

The experiment results are shown in FIG. 7. In FIG. 7, the horizontal axis represents the separation air velocity from the second air nozzle 121 and the vertical axis represents the suction air velocity from the suction fan 130. An open dot represents the case in which an image forming operation for a recording sheet has been finally performed with no problem and a cross represents the case in which some problems have been produced.

The present experiment made it clear that even with constant separation air velocity, when the suction, air velocity was allowed to large, the suction force became excessively large, whereby a phenomenon was created in which a recording sheet adhered to the sheet discharging guide plate 85 shown in FIG. 3 and then the recording sheet was not smoothly discharged. In contrast, when the suction air velocity was allowed to small, the suction force became insufficient and then the recording sheet could not be inhibited from undulating, resulting in occurrence of image defects. Therefore, appropriate suction air velocity needs to be set depending on the separation air velocity.

Incidentally, the optimum numbers of the separation air velocity and the suction air velocity differ depending on the constitution and size of the fixing device. Therefore, determination needs to be made by an experiment for each designated fixing device.

This case confirmed that in cases in which the suction air velocity was 2 m/s, even when the separation air velocity was changed, a recording sheet was able to be certainly inhibited from undulating to discharge the recording sheet, and even a recording sheet of 50 $g/m^2$ was able to be stably discharged. In contrast, when the thickness of a recording sheet is increased, stiffness is increased and the resisting force against undulation is increased, whereby sheet dischargeable range is increased. Then, the setting of the separation air velocity at 40 m/s and of the suction air velocity at 2 m/s confirmed that a recording sheet of about 50 $g/m^2$ or more was able to be discharged.

Figure 8:
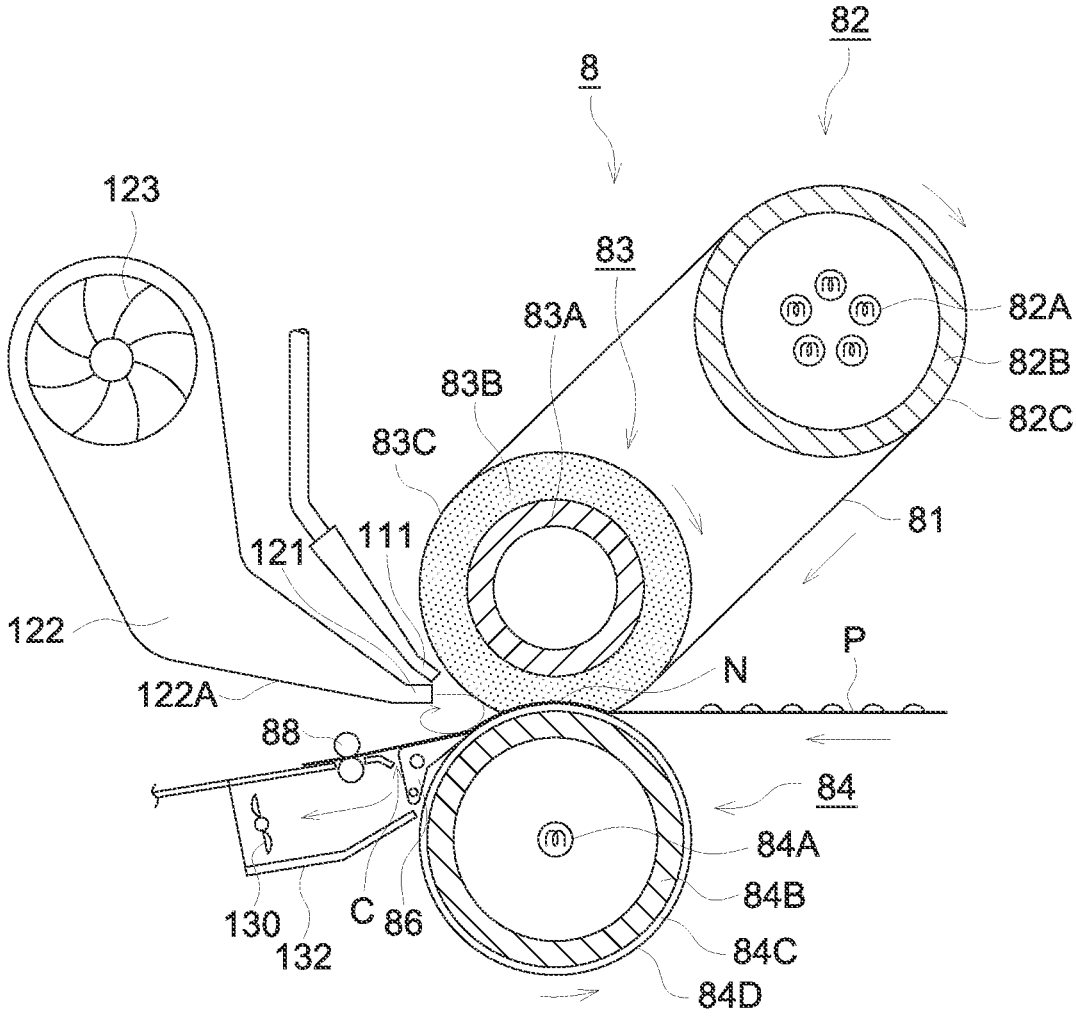
FIG. 8 is a sectional view of a belt fixing device provided with no sheet, discharging guide plate.

Herein, instead of the embodiment shown in FIG. 2, the embodiment shown in FIG. 8 is employable. In the fixing device, shown in FIG. 8, the sheet discharging guide plate 85 in FIG. 2 is not provided. Therefore, a recording sheet P having been discharged from the nip portion N is discharged along the outer wall of the suction duct 132 serving as a second guide member.

Further, the present invention can be applied to the case where below the duct 122, a dedicated guide plate is arranged to serve as a first guide member.

In addition, the above fixing device 8 has a first air nozzle 111 to eject compressed air and a second air nozzle 121 to eject air having been blown by a fan. However, even when only either the first air nozzle 111 or the second air nozzle 121 is provided to serve as an air ejection section, a recording sheet P can be separated and a swirling current due to ejected air may be occasionally generated. Therefore, the present invention can also be applied to such a case.

According to the fixing device and the image forming apparatus of the present embodiment, in cases in which air is blown to separate a recording sheet, even when the air volume is increased in response to speeding-up and thin paper, there are generated no image defects resulting from contact of a recording sheet to the guide member due to undulation of the recording sheet having been discharged after fixing.

What is claimed is:

1. A fixing device to fix a toner image on a recording medium in a nip portion formed by a heated fixing member and a pressure member to press the fixing member, the fixing device comprising:

an air ejection section to eject and blow air against the recording medium to separate the recording medium from the fixing member, a first guide member provided on a fixing face side of the recording medium discharged from the nip portion to guide the recording medium, a second guide member provided on a non-fixing face side of the recording medium discharged from the nip portion to guide the recording medium, also having a predetermined clearance with respect to the pressure member, and an air suction section provided on an opposite side position with respect to the first guide member in the second guide member to suction air of the clearance and attract the recording medium to the second guide member.

2. The fixing device of the claim 1, wherein the air ejection section ejects air blown by a fan.

3. The fixing device of the claim 1 further comprises a second air ejection section to eject high pressure air produced by a compressor in which at the opposite side position with respect to the first guide member in the air ejection section.

4. The fixing device, of the claim 1, wherein the first guide member is a side wall of a duct of the air ejection section.

5. The fixing device of the claim 1, wherein the second guide member is an outer wall of a duct of the air suction section.

6. The fixing device of claim 1 further comprises a separation claw to separate the recording medium from the pressure member.

7. The fixing device of the claim 6, wherein a plurality of the separation claws is arranged at the clearance with a predetermined interval, and the air suction section executes the suction of air through the clearance.

8. An image forming apparatus provided with a fixing device described in the claim 1.

* * * * *